US008489310B2

(12) United States Patent
Shimamura et al.

(10) Patent No.: US 8,489,310 B2
(45) Date of Patent: Jul. 16, 2013

(54) CONTROL APPARATUS FOR GENERAL-PURPOSE ENGINE

(75) Inventors: Hideaki Shimamura, Wako (JP); Takao Tamechika, Wako (JP); Atsuhisa Ishikawa, Wako (JP)

(73) Assignee: Honda Motor Co., Ltd, Tokyo (JP)

( * ) Notice: Subject to any disclaimer, the term of this patent is extended or adjusted under 35 U.S.C. 154(b) by 614 days.

(21) Appl. No.: 12/763,777

(22) Filed: Apr. 20, 2010

(65) Prior Publication Data

US 2010/0269787 A1 Oct. 28, 2010

(30) Foreign Application Priority Data

Apr. 27, 2009 (JP) ..... 2009-107980

(51) Int. Cl.
*F02D 41/06* (2006.01)
*F02M 51/00* (2006.01)

(52) U.S. Cl.
USPC ..... 701/113; 123/179.16; 123/480

(58) Field of Classification Search
USPC ..... 123/478, 480, 486, 487, 488, 491, 123/494, 179.16, 179.18; 701/102, 103, 113, 701/115
See application file for complete search history.

(56) References Cited

U.S. PATENT DOCUMENTS 3,882,451 A * 5/1975 Fujishiro et al. ..... 340/449
5,586,448 A * 12/1996 Ikeda et al. ..... 62/156
6,240,896 B1 * 6/2001 Ueda et al. ..... 123/299
6,445,997 B2 * 9/2002 Thomas ..... 701/113
6,494,186 B1 * 12/2002 Wakeman ..... 123/479
6,523,525 B1 * 2/2003 Hawkins ..... 123/491
6,866,027 B1 * 3/2005 Marchesini et al. ..... 123/480
6,986,413 B2 * 1/2006 Fedders et al. ..... 188/267.2
7,075,788 B2 * 7/2006 Larson et al. ..... 361/695
7,441,453 B2 * 10/2008 Durand ..... 73/170.26
7,865,327 B2 * 1/2011 Koehler et al. ..... 702/133

(Continued)

FOREIGN PATENT DOCUMENTS

DE 3911310 A1 10/1990
EP 0103226 A2 3/1984

(Continued)

OTHER PUBLICATIONS

Japanese Office Action dated Mar. 15, 2011, issued in corresponding Japanese Patent Application No. 2009-107980.

(Continued)

*Primary Examiner* — Thomas Moulis
(74) *Attorney, Agent, or Firm* — Westerman, Hattori, Daniels & Adrian, LLP

(57) ABSTRACT

In an apparatus for controlling a general-purpose internal combustion engine having an electronic control unit (ECU) mounted on an electronic circuit board installed near a body of the engine and being connectable to a load such as an operating machine that consumes power generated by the engine, there are equipped with a first temperature sensor installed on the board at a position remote from the body and a second temperature sensor installed on the board at a position closer to the body than the first temperature sensor. A warm-up time period is determined based on an output of the first temperature sensor and a difference between outputs of the first and second temperature sensors, and an engine speed is controlled to a predetermined operating speed when the determined warm-up time period has elapsed (S18, S22), thereby improving the fuel efficiency and preventing engine stall.

4 Claims, 5 Drawing Sheets

U.S. PATENT DOCUMENTS

| | | | | |
|---|---|---|---|---|
| 8,036,818 | B2 * | 10/2011 | Kasai et al. | 701/113 |
| 8,161,931 | B2 * | 4/2012 | Geyer | 123/179.16 |
| 8,219,305 | B2 * | 7/2012 | Iwata et al. | 701/113 |
| 2004/0206326 | A1 * | 10/2004 | North | 123/179.18 |
| 2005/0042947 | A1 | 2/2005 | Saito | |
| 2007/0271904 | A1 | 11/2007 | Shouda et al. | |
| 2009/0271097 | A1 | 10/2009 | Kasai et al. | |
| 2009/0299614 | A1 * | 12/2009 | Iwata et al. | 701/113 |
| 2010/0095909 | A1 * | 4/2010 | Lin et al. | 123/41.02 |
| 2010/0145595 | A1 * | 6/2010 | Bellistri et al. | 701/103 |
| 2011/0067665 | A1 * | 3/2011 | Beckmann et al. | 123/179.21 |
| 2011/0172876 | A1 * | 7/2011 | Kimoto et al. | 701/34 |
| 2011/0216429 | A1 * | 9/2011 | Lynam et al. | 359/871 |
| 2012/0006907 | A1 * | 1/2012 | Niemann et al. | 236/44 C |
| 2012/0123664 | A1 * | 5/2012 | Wertz et al. | 701/110 |

FOREIGN PATENT DOCUMENTS

| | | | |
|---|---|---|---|
| JP | 7-8566 | A | 1/1995 |
| JP | 10-318019 | A | 12/1998 |
| JP | 2004-108277 | A | 4/2004 |
| JP | 2005-299519 | A | 10/2005 |
| JP | 2005-299678 | A | 10/2005 |
| JP | 2008-249695 | A | 10/2008 |

OTHER PUBLICATIONS

European Search Report dated Jun. 8, 2010, issued in corresponding European Patent Application No. 10160847.

* cited by examiner

FIG.5

WARM-UP TIME PERIOD TABLE

| | | FIRST TEMPERATURE T1 [°C] | | | | |
|---|---|---|---|---|---|---|
| | | −20.0 | −10.0 | 0.0 | 10.0 | 20.0 |
| TEMPERATURE DIFFERENCE Td [°C] | 0.0 | 112 | 67 | 40 | 24 | 0 |
| | 2.5 | 56 | 34 | 20 | 12 | 0 |
| | 5.0 | 45 | 27 | 16 | 10 | 0 |
| | 7.5 | 36 | 22 | 13 | 0 | 0 |
| | 10.0 | 29 | 17 | 10 | 0 | 0 |
| | 12.5 | 23 | 14 | 0 | 0 | 0 |
| | 15.0 | 0 | 0 | 0 | 0 | 0 |

UNIT [sec]

CONTROL APPARATUS FOR GENERAL-PURPOSE ENGINE

BACKGROUND OF THE INVENTION

1. Field of the Invention

This invention relates to a control apparatus for a general-purpose internal combustion engine, particularly to an apparatus for controlling warm-up operation of the general-purpose internal combustion engine.

2. Description of the Related Art

Conventionally, in general-purpose internal combustion engines used as prime movers for operating machines such as generators and various other equipment, warm-up operation is conducted after engine start to stabilize the engine speed for preventing engine stall due to abrupt change in load.

In Japanese Laid-Open Utility Model Application No. Hei 7(1995)-8566, it is taught in a vehicle engine to determine a warm-up time period based on the ambient temperature and start the engine by the warm-up time period before the time of engine start designated by the driver so as to complete the warm-up operation before the designated engine start time.

SUMMARY OF THE INVENTION

In the general-purpose engine, when the warm-up operation is conducted more than necessary, the fuel efficiency deteriorates accordingly, while the insufficient warm-up operation leads to unstable engine speed and subsequently engine stall, so that it is preferable to conduct the warm-up operation for an appropriate time period.

However, since an appropriate warm-up time period changes depending not only on the ambient temperature but on the engine temperature, if it is determined based solely on the ambient temperature as in the reference, the warm-up time period could become inappropriate in some cases depending on the engine temperature and it may lead to disadvantages such as the deterioration in fuel efficiency, the engine stall and the like.

It will be possible to install a temperature sensor on the body (e.g., a cylinder block) of the engine to detect the engine temperature such that the warm-up time period is determined taking the detected engine temperature into account. Disadvantageously, this makes the structure complicated.

An object of this invention is therefore to overcome the foregoing problems by providing a control apparatus for a general-purpose engine that can determine an appropriate warm-up time period with a simple structure, thereby improving the fuel efficiency and preventing engine stall.

In order to achieve the object, this invention provides in its first aspect an apparatus for controlling a general-purpose internal combustion engine having an electronic control unit mounted on an electronic circuit board installed near a body of the engine and being connectable to a load that consumes power generated by the engine, comprising: a first temperature sensor installed on the board at a position remote from the body; a second temperature sensor installed on the board at a position closer to the body than the first temperature sensor; a warm-up time period determiner that determines a warm-up time period of the engine based on an output of the first temperature sensor and a difference between outputs of the first temperature sensor and the second temperature sensor when the engine has been started; and an engine speed controller that controls speed of the engine to a predetermined operating speed when the determined warm-up time period has elapsed.

In order to achieve the object, this invention provides in its second aspect a method of controlling a general-purpose internal combustion engine having an electronic control unit mounted on an electronic circuit board installed near a body of the engine and being connectable to a load that consumes power generated by the engine, a first temperature sensor installed on the board at a position remote from the body and a second temperature sensor installed on the board at a position closer to the body than the first temperature sensor, comprising the steps of: determining a warm-up time period of the engine based on an output of the first temperature sensor and a difference between outputs of the first temperature sensor and the second temperature sensor when the engine has been started; and controlling speed of the engine to a predetermined operating speed when the determined warm-up time period has elapsed.

BRIEF DESCRIPTION OF THE DRAWINGS

The above and other objects and advantages of the invention will be more apparent from the following description and drawings in which:

FIG. 5 is an explanatory view showing table characteristics of a warm-up time period relative to a first temperature and temperature difference, which is used in the FIG. 4 flowchart.

DETAILED DESCRIPTION OF THE PREFERRED EMBODIMENT

A control apparatus for a general-purpose engine according to a preferred embodiment of the present invention will now be explained with reference to the attached drawings.

Figure 1:
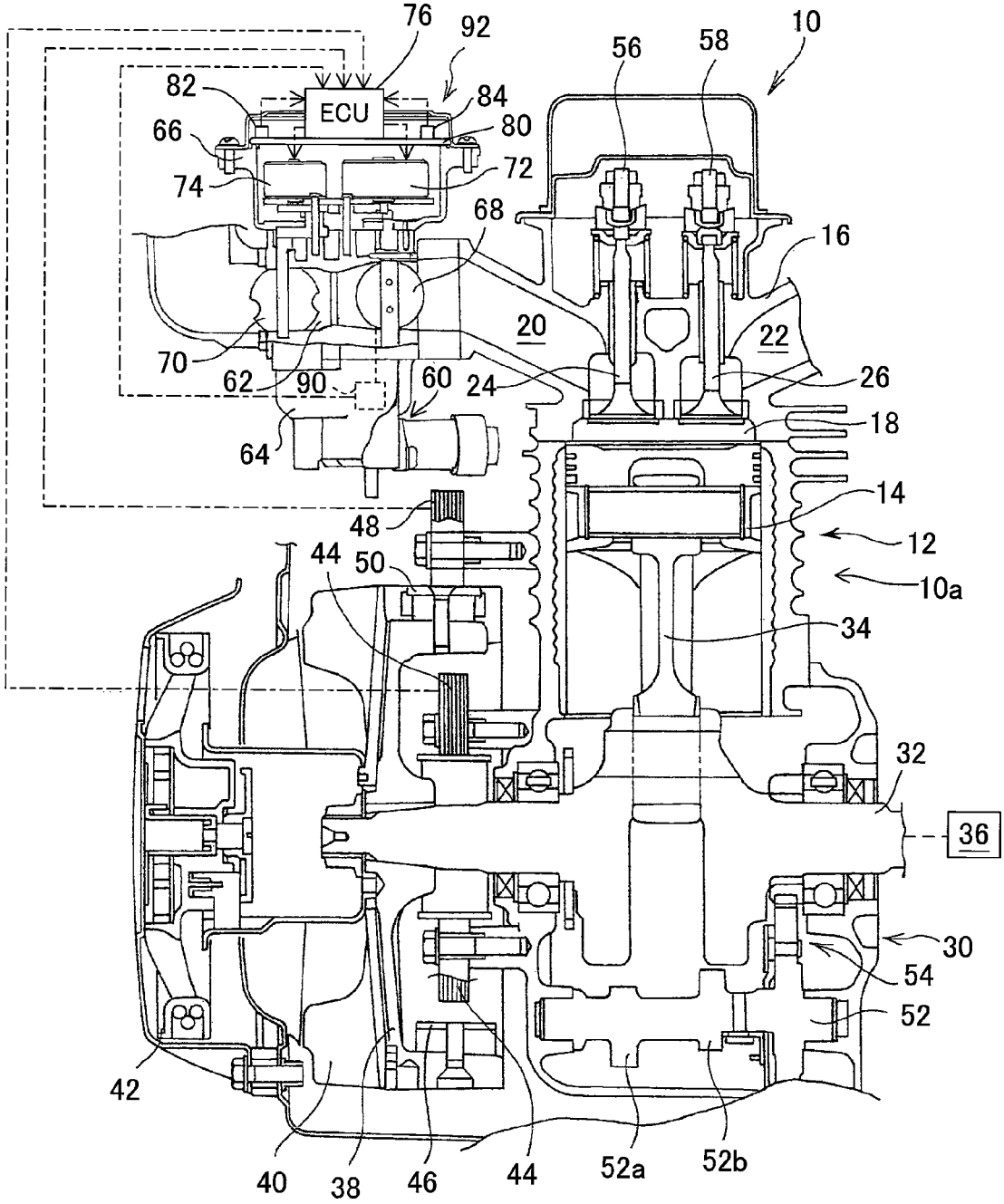
FIG. 1 is an overall view of a control apparatus for a general-purpose engine according to an embodiment of this invention.

FIG. 1 is an overall view of a control apparatus for a general-purpose engine according to an embodiment of this invention.

In FIG. 1, reference numeral 10 designates a general-purpose internal combustion engine (hereinafter referred to as "engine"). The engine 10 is a gasoline-injection, single-cylinder, air-cooled, four-cycle, OHV engine with a displacement of, for example, 163 cc.

A cylinder formed in a cylinder block 12 of the engine 10 accommodates a piston 14 that reciprocates therein. A cylinder head 16 is attached to the top of the cylinder block 12. The cylinder head 16 is formed with a combustion chamber 18 facing the crown of the piston 14, and provided with an intake port 20 and exhaust port 22 that communicate with the combustion chamber 18. An intake valve 24 and exhaust valve 26 are installed near the intake port 20 and exhaust port 22, respectively.

A crankcase 30 is attached to the bottom of the cylinder block 12 and houses a crankshaft 32 to be rotatable therein. An engine body 10*a* includes the cylinder block 12, cylinder head 16, crankcase 30 and other components.

The crankshaft 32 is connected to the bottom of the piston 14 through a connecting rod 34. One end of the crankshaft 32 is connected with a load (e.g., a generator) 36 so that the engine 10 supplies power to the load 36.

It should be noted that a term "load" has meanings of a machine or equipment that consumes power or energy (output) generated by a prime mover and of the amount of power output consumed by the machine, and this embodiment uses the load 36 in the former meaning, precisely an operating machine such as a generator, snowplow, high-pressure washing machine, or other devices. Further, in this embodiment, a phrase that the engine 10 is "under no load condition" indicates a condition where the load 36 does not consume power generated by the engine 10.

The other end of the crankshaft 32 is attached with a flywheel 38, cooling fan 40 and recoil starter 42 used for engine start. A power coil (generator coil) 44 is attached to the crank case 30 in the inside of the flywheel 38 and magnets (permanent magnet pieces) 46 are attached on a back surface of the flywheel 38. The power coil 44 and magnets 46 constitute a multipolar generator that produces electric power in synchronization with rotation of the crankshaft 32.

A pulsar coil 48 is attached to the crank case 30 in the outside of the flywheel 38 and magnets (permanent magnet pieces) 50 are attached on a top surface of the flywheel 38. The pulsar coil 48 produces an output indicative of a crank angle corresponding to ignition timing of the engine 10 every time the magnet 50 passes.

A camshaft 52 is rotatably housed in the crank case 30 to be parallel with the axis line of the crankshaft 32 and connected via a gear mechanism 54 to the crankshaft 32 to be driven thereby. The camshaft 52 is equipped with an intake cam 52*a* and exhaust cam 52*b* to operate the intake valve 24 and exhaust valve 26 through a push rod (not shown) and rocker arms 56, 58.

A carburetor 60 is connected to the intake port 20. The carburetor 60 unitarily comprises an air intake passage 62, carburetor assembly 64 and housing case 66. The air intake passage 62 is installed with a throttle valve 68 and choke valve 70.

The carburetor assembly 64 is supplied with fuel from a fuel tank (not shown) to produce air-fuel mixture by injecting fuel by an amount defined by the opening of the throttle valve 68 (and choke valve 70) to be mixed with intake air flowing through the air intake passage 62.

The produced air-fuel mixture passes through the intake port 20 and intake valve 24 to be sucked into the combustion chamber 18 and is ignited by an ignitor to burn. The resulting combustion gas (exhaust gas) is discharged to the exterior of the engine 10 through the exhaust valve 26, exhaust port 22, a muffler (not shown), etc.

The housing case 66 is installed near the engine body 10*a* (i.e., near the cylinder block 12 and cylinder head 16) and houses an electric throttle motor (actuator) 72 for operating the throttle valve 68, an electric choke motor (actuator) 74 for operating the choke valve 70 and an electronic circuit board 80 on which an electronic control unit (ECU) 76 controlling the operations of the motors 72, 74, etc., is mounted. The board 80 is thus placed near the engine body 10*a*.

The throttle and choke motors 72, 74 comprise stepper motors.

Figure 2:
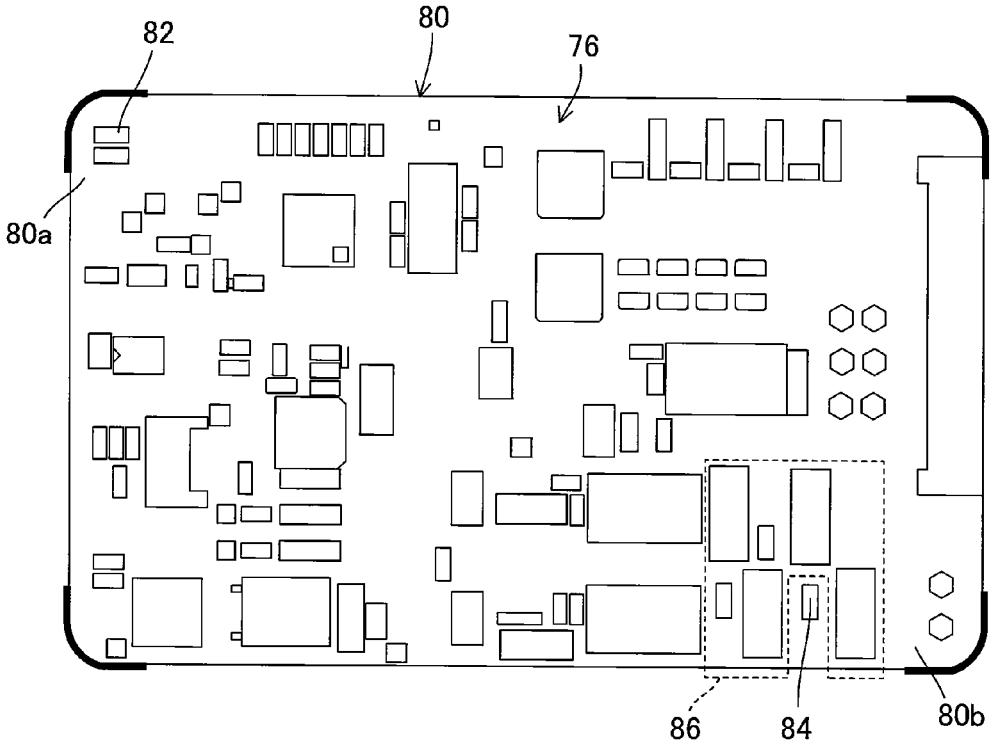
FIG. 2 is a plan view of an electronic circuit board shown in FIG. 1 with a housing case removed.

FIG. 2 is a plan view of the board 80 shown in FIG. 1 with the housing case 66 removed. In the drawing, the right side is the side close to the engine body 10*a* and the left side the side away therefrom.

As shown in FIG. 2, the board 80 is installed with a plurality of, i.e., two temperature sensors, more exactly a first temperature sensor (ambient temperature sensor) 82 and second temperature sensor (engine temperature sensor) 84 both comprising thermistors and other components.

The first temperature sensor 82 is installed at the edge (the upper left of FIG. 2) 80*a* of the board 80, i.e., at a position remote from the engine body 10*a*. Specifically, it is located on the board 80 at a position that is less likely influenced by the engine temperature (precisely, by heat emitted from the engine 10) but is likely influenced by the ambient temperature, in other words, at a position (in an area) whose temperature is likely to change in response to the ambient temperature but is less likely change by the engine heat regardless of which the engine 10 is operated or not.

As a result, the surrounding temperature of the first temperature sensor 82 is not influenced by the operating condition of the engine 10 but is substantially proportional to the ambient temperature. Thus the first temperature sensor 82 produces an output or signal indicative of the temperature (hereinafter called the "first temperature T1") proportional to the ambient temperature.

The second temperature sensor 84 is installed at the edge (the lower right in FIG. 2) 80*b* of the board 80 on the opposite side of the edge 80*a*, i.e., at a position closer to the engine body 10*a* by a predetermined distance than the first temperature sensor 82. A circuit, e.g., a power circuit (electronic components surrounded by a dashed line in FIG. 2) 86 is installed near the second temperature sensor 84. The circuit 86 generates heat when operating power is supplied, i.e., upon operation of the engine 10.

Thus the second temperature sensor 84 is installed on the board 80 at a position that is likely to be influenced by the engine temperature (precisely, heat from the engine 10) or heat from the circuit 86 and whose temperature changes in accordance with the engine temperature.

Accordingly, the surrounding temperature of the second temperature sensor 84 gradually increases to predetermined temperature upon start of the engine 10 and gradually decreases after engine stop. The engine temperature changes in accordance with the operating condition of the engine 10 similarly to the surrounding temperature of the second temperature sensor 84.

Since the surrounding temperature of the second temperature sensor 84 is proportional to the engine temperature, the second temperature sensor 84 produces an output or signal indicative of the temperature (hereinafter called the "second temperature T2") proportional to the engine temperature.

Returning to the explanation on FIG. 1, a throttle opening sensor 90 having a potentiometer is installed near the throttle valve 68 and produces an output or signal corresponding to the opening of the throttle valve 68, i.e., throttle opening.

The outputs of the throttle opening sensor 90 and first and second temperature sensors 82, 84 and also outputs of the power coil 44 and pulsar coil 48 are sent to the ECU 76. The ECU 76 includes a microcomputer having a CPU, ROM, RAM, input/output circuits and other devices.

Figure 3:
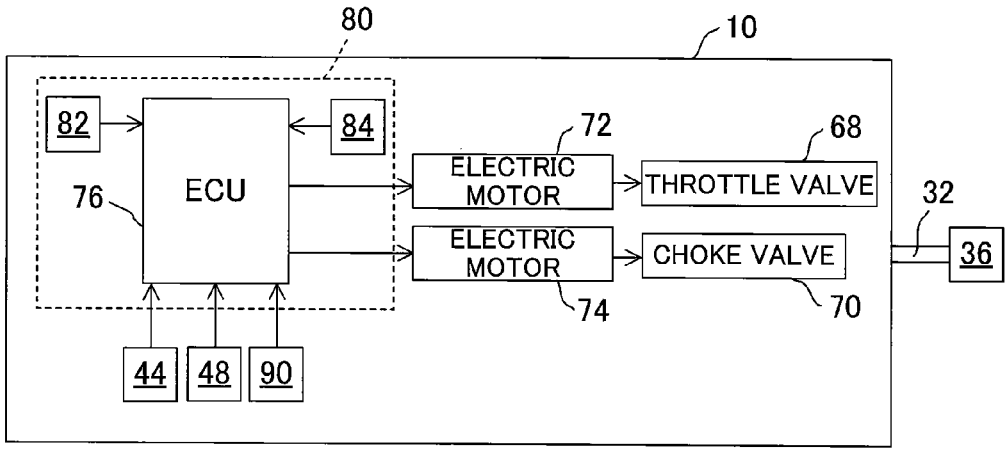
FIG. 3 is a block diagram showing the configuration of the apparatus shown in FIG. 1.

FIG. 3 is a block diagram showing the configuration of the apparatus shown in FIG. 1.

The ECU 76 will be explained with reference to FIG. 3. The output (alternating current) of the power coil 44 is sent to a bridge circuit (not shown) in the ECU 76, where it is converted to direct current through full-wave rectification to be supplied as operating power to the ECU 76, throttle motor 72 and the like, and also sent to a pulse generation circuit (not shown), where it is converted to a pulse train signal. The output of the pulsar coil 48 is used as an ignition signal of the ignitor.

The CPU of the ECU 76 detects the engine speed based on the converted pulse signal and controls the operations of the throttle motor 72 and choke motor 74 based on the detected engine speed and the outputs of the throttle opening sensor 90 and temperature sensors 82, 84, while controlling the ignition through the ignitor.

Thus the engine 10 includes an electronic governor 92 that regulates the engine speed by using the throttle motor 72 which operates the throttle valve 68 in the air intake passage 62.

Figure 4:
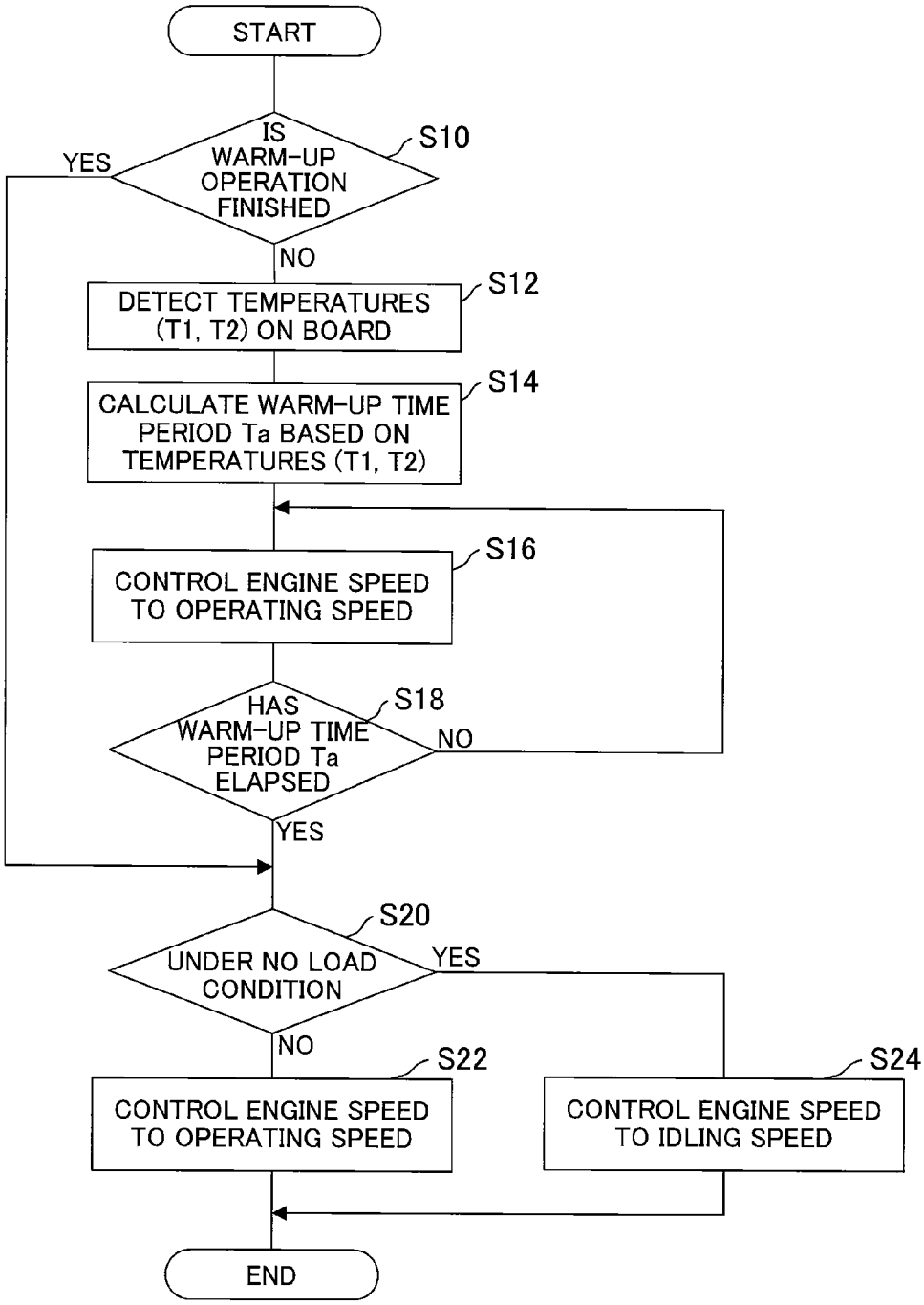
FIG. 4 is a flowchart showing the processing of controlling engine speed, etc., among the operations of the apparatus shown in FIG. 1.

FIG. 4 is a flowchart showing the processing of controlling the engine speed, etc., among the operations of the apparatus according to the embodiment. The illustrated program is executed by the ECU 76 at predetermined intervals (e.g., 100 milliseconds) after the engine 10 is started.

The program begins in S10, in which it is determined whether the warm-up operation of the engine 10 is finished. Since this processing is conducted immediately after the engine start, the result in S10 is usually NO and the program proceeds to S12, in which the temperature on or above the board 80 is detected.

Specifically, the temperature in the vicinity of the edge 80*a* of the board 80, i.e., the first temperature T1 proportional to the ambient temperature is detected based on the output of the first temperature sensor 82, while the temperature in the vicinity of the edge 80*b*, i.e., the second temperature T2 proportional to the engine temperature is detected based on the output of the second temperature sensor 84.

The program then proceeds to S14, in which a warm-up time period Ta of the engine 10 is calculated based on the detected first and second temperatures T1, T2. Specifically, a temperature difference Td between the second and first temperatures 12, T1 (precisely, a difference obtained by subtracting the first temperature T1 from the second temperature T2) is calculated and the warm-up time period Ta is calculated by retrieving a table shown in FIG. 5 using the calculated temperature difference Td and first temperature T1.

The table data illustrated in FIG. 5 is experimentally obtained and stored in the ROM beforehand. The term "warm-up time period" indicates a time period of warm-up operation, more precisely, a time period required after starting the warm-up operation following the engine start until establishing an operating condition (completely-warmed condition) where the engine stall can surely be avoided even when, for example, the throttle valve 68 is abruptly opened or closed (when the applied load is abruptly changed).

As can be seen in FIG. 5, when the first temperature T1 proportional to the ambient temperature is relatively low (e.g., −20° C.) and the temperature difference Td is small, it is assumed that the engine 10 is used in a cold place and is started after elapse of a certain time period since the last engine stop (so-called the "cold start"), so that the warm-up time period Ta is set to be relatively long.

The warm-up time period Ta is set to decrease with increasing difference Td. Specifically, when the difference Td is relatively large, since it is assumed that the engine 10 is started after elapse of a short period since the last engine stop (so-called the "hot start"), the warm-up time period Ta is set to be short (or 0 second, which means no warm-up operation).

This configuration is made because, when the difference Td is relatively large (when it is under the hot start), the short warm-up time period suffices and when the difference Td is relatively small (when it is under the cold start), the long warm-up time period is required for completing the warm-up operation.

The further explanation is made in detail. When the first temperature T1 is −20° C. and the difference Td is 0° C. (which means that the second temperature T2 is also −20° C.), it is assumed to be the cold start and the warm-up time period Ta is determined to be 112 seconds.

When the first temperature T1 is −20° C. and the difference Td is 15° C. (which means that the second temperature T2 is −5° C.), it is assumed to be the hot start and the warm-up time period Ta is determined to be 0 second. When the first temperature T1 is relatively high (i.e., higher than 20° C.), since the warm-up operation is not necessary, the warm-up time period Ta is determined to be 0 second regardless of the difference Td.

Although omitted in FIG. 5, when the first temperature T1 is greater than the second temperature T2 (when the difference Td is a negative value), the warm-up time period Ta is determined to be 0 second regardless of the first temperature T1.

In this manner, in S14, after the engine 10 is started, the warm-up time period Ta is determined based on the output (first temperature T1) of the first temperature sensor 82 and the difference (temperature difference Td) between the outputs of the second and first temperature sensors 84, 82. Upon determination of the warm-up time period Ta, the warm-up operation is conducted in another routine (not shown).

Specifically, the operation of the choke motor 74 is controlled to operate the choke valve 62 in the closing direction since engine start until the warm-up time period Ta has elapsed. As a result, an amount of fuel to be supplied to the air intake passage 62 is increased and the engine 10 is warmed up, thereby enhancing engine start-up performance.

The program then proceeds to S16, in which the operation of the throttle motor 72 is controlled so that the engine speed becomes predetermined operating speed which is set in accordance with nature or type of the connected load 36.

The program next proceeds to S18, in which it is determined whether the warm-up time period Ta has elapsed. This determination is made by starting a counter in another routine (not shown) after the warm-up operation was started following the engine start and checking as to whether the counter value reaches a value corresponding to the warm-up time period Ta.

When the result in S18 is negative, the program returns to S16 to repeat the foregoing processing, while, when the result is affirmative, the program proceeds to S20. When the result in S18 is affirmative, i.e., the warm-up time period Ta has elapsed and the warm-up operation has been finished, the result in S10 in the next and ensuing program loops becomes affirmative and the program proceeds to S20 (i.e., the steps of S12 to S18 are skipped).

In S20, it is determined whether the engine 10 is under the no load condition where the connected load 36 such as an operating machine does not consume power generated by the engine 10. This determination is made based on the throttle opening.

Specifically, a threshold value is set to a value obtained by adding a predetermined value to the throttle opening when the engine speed is converged to the predetermined operating speed so that the engine 10 is stably operated, a number of times that the throttle opening is less than the threshold value is counted, and when the counted number of times exceeds a prescribed value, the engine 10 is determined to be under the no load condition.

With this, the threshold value can be appropriately set and the no load condition can be accurately determined. Further, since the no-load condition is determined when the number of times that the throttle opening is less than the threshold value exceeds the prescribed value, it makes possible to appropriately set the predetermined value and hence, it becomes possible to avoid determining a condition where small load is given as the no load condition. Details of the above no-load condition determination are described in Japanese Laid-Open Patent Application No. 2008-249695 proposed by the applicant earlier and the further explanation is omitted here.

When the result in S20 is negative, the program proceeds to S22, in which the engine speed is controlled to achieve or maintained the predetermined operating speed.

On the other hand, when the result is affirmative, the program proceeds to S24, in which the engine speed is controlled to the idling speed set lower than the operating speed.

The engine speed is thus controlled to the idling speed under the no load condition, since the engine 10 is operated at the predetermined operating speed until the warm-up operation has been finished as described above. The engine stall can be prevented even when, for example, the load 36 is operated immediately after the idling speed is established and the throttle valve 68 is abruptly opened (the applied load is abruptly changed).

As stated above, this embodiment is configured to have an apparatus for and a method of controlling a general-purpose internal combustion engine (10) having an electronic control unit (ECU 76) mounted on an electronic circuit board (80) installed near a body (10*a*) of the engine and being connectable to a load (36) that consumes power generated by the engine, characterized by: a first temperature sensor (82) installed on the board at a position (80*a*) remote from the body; a second temperature sensor (84) installed on the board at a position (80*b*) closer to the body than the first temperature sensor; a warm-up time period determiner (ECU 76, S14) that determines a warm-up time period (Ta) of the engine based on an output (T1) of the first temperature sensor and a difference (Td) between outputs (T1, T2) of the first temperature sensor and the second temperature sensor when the engine has been started; and an engine speed controller (ECU 76, S18, S22) that controls speed of the engine to a predetermined operating speed when the determined warm-up time period has elapsed. The predetermined operating speed is set in accordance with nature of the load.

Thus, the first temperature sensor 82 is installed on the board 80 at a position (edge 80*a*) that is less likely influenced by the engine temperature but is likely influenced by the ambient temperature, while the second temperature sensor 84 is installed on the board 80 at a position (edge 80*b*) that is much influenced by the engine temperature and whose temperature changes in response to the engine temperature, and upon start of the engine 10, the warm-up time period Ta is determined based on the outputs (first and second temperatures T1, T2) of the sensors 82, 84. With this, it becomes possible to appropriately determine the warm-up time period Ta in accordance with the ambient temperature and engine temperature with a simple structure. Further, the warm-up operation can be finished in the appropriate warm-up time period Ta, thereby improving the fuel efficiency and preventing engine stall.

Further, regardless of ambient temperature of a place where the engine 10 is used (such as a cold region), the warm-up time period Ta can be appropriately set.

Further, after the warm-up time period Ta has elapsed and the warm-up operation has been finished, the engine 10 can be operated at the predetermined operating speed set in accordance with the connected operating machine (load 36; e.g., a generator).

The apparatus and method further includes: a load condition determiner that determines whether the engine is under no load condition where the load does not consume power generated by the engine when the determined warm-up time period has elapsed, and the engine speed controller controls the speed of the engine to an idling speed when the engine is determined to be under the no load condition. With this, the engine speed in the no-load condition can be decreased to the idling speed, thereby mitigating noise and further improving the fuel efficiency.

When it is configured to determine whether the engine 10 is under the no load condition based on the throttle opening, it becomes possible to avoid making misjudgment. To be specific, since the throttle opening tends to greatly change during the warm-up operation, if the no load condition determination is made based on the throttle opening during that operation, the engine 10 could be determined to be under the no load condition despite the fact that the load is actually applied. However, since the determination is made after the warm-up time period Ta has elapsed and the warm-up operation has been finished, i.e., at the time when the throttle opening is relatively stable, as described above, misjudgment can be avoided.

It should be noted that, although the warm-up time period Ta, displacement of the engine 10, etc., are indicated with specific values in the foregoing, they are only examples and not limited thereto.

It should also be noted that, although fuel is supplied using the carburetor 60, an injector (fuel injection valve) can be installed at the intake port 20 to supply fuel instead.

Japanese Patent Application No. 2009-107980 filed on Apr. 27, 2009, is incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for controlling a general-purpose internal combustion engine having an electronic control unit mounted on an electronic circuit board installed near a body of the engine and being connectable to a load that consumes power generated by the engine, comprising:

a first temperature sensor installed on the board at a position remote from the body;

a second temperature sensor installed on the board at a position that is closer to the body than the first temperature sensor and a power circuit is installed nearby;

a warm-up time period determiner that determines a warm-up time period of the engine based on an output of the first temperature sensor and a difference between outputs of the first temperature sensor and the second temperature sensor when the engine has been started;

a load condition determiner that determines whether the engine is under a no load condition where the load does not consume power generated by the engine when the determined warm-up time period has elapsed; and an engine speed controller that controls speed of the engine to a predetermined operating speed by using a throttle motor to operate a throttle valve when the engine is determined to be under the no load condition, wherein the first temperature sensor and the second temperature sensor are installed on opposite edges of the board, respectively, the load condition determiner compares a throttle opening of the engine with a threshold value and determines that the engine is under the no load condition when a number of times that the throttle opening is less than the threshold value exceeds a prescribed value, and the engine speed controller controls the speed of the engine to an idling speed by using the throttle motor when the engine is determined to be under the no load condition.

2. The apparatus according to claim 1, wherein the predetermined operating speed is set in accordance with nature of the load.

3. A method of controlling a general-purpose internal combustion engine having an electronic control unit mounted on an electronic circuit board installed near a body of the engine and being connectable to a load that consumes power generated by the engine, a first temperature sensor installed on the board at a position remote from the body and a second temperature sensor installed on the board at a position that is closer to the body than the first temperature sensor, comprising the steps of:

determining a warm-up time period of the engine based on an output of the first temperature sensor and a difference between outputs of the first temperature sensor and the second temperature sensor when the engine has been started;

determining whether the engine is under a no load condition where the load does not consume power generated by the engine when the determined warm-up time period has elapsed; and controlling speed of the engine to a predetermined operating speed when the determined warm-up time period has elapsed wherein the determining compares a throttle opening of the engine with a threshold value and determines that the engine is under the no load condition when a number of times that the throttle opening is less than the threshold value exceeds a prescribed value, and the controlling controls the speed of the engine to an idling speed by using the throttle motor when the engine is determined to be under the no load condition.

4. The method according to claim 3, wherein the predetermined operating speed is set in accordance with nature of the load.

* * * * *